US005823368A

United States Patent [19]

Burke et al.

[11] Patent Number: 5,823,368

[45] Date of Patent: Oct. 20, 1998

[54] DISPLAY RACK

[75] Inventors: Wade P. Burke, Watauga; Ray M. Lewis II, Fort Worth, both of Tex.

[73] Assignee: Marco Display Specialists, Inc., Fort Worth, Tex.

[21] Appl. No.: 850,606

[22] Filed: May 2, 1997

[51] Int. Cl.[6] ..... A47F 5/00

[52] U.S. Cl. ..... 211/175; 211/149; 108/143; 312/334.2

[58] Field of Search ..... 211/175, 149, 211/150, 195, 151; 312/334.2; 280/79.3; 108/143

[56] References Cited

U.S. PATENT DOCUMENTS

| | | | |
|---|---|---|---|
| 1,061,646 | 5/1913 | Welliver . | |
| 3,745,936 | 7/1973 | Bennett | 108/143 X |
| 5,351,976 | 10/1994 | Penson | 280/79.3 X |
| 5,439,122 | 8/1995 | Ramsay | 211/128.1 X |
| 5,590,796 | 1/1997 | Herman | 211/149 |

OTHER PUBLICATIONS

Brochure of Item No. BAK–400, The Marco Company.
Brochure of Item No. BAK–402, The Marco Company.
Brochure of Item No. Cart–03, The Marco Company.
Brochure of Cart–02 With Liner and Riser, The Marco Company.
Brochure of Cart–04, The Marco Company.

*Primary Examiner*—Robert W. Gibson, Jr.
*Attorney, Agent, or Firm*—Geoffrey A. Mantooth

[57] ABSTRACT

The display rack has a frame with a top wall and side walls and a cavity therein. The frame contains plural nested shelves that can pulled out of the cavity to an extended position or pushed into the cavity. The nested shelves can individually be nested to allow selective adjustment of the amount of shelf space that is available for use. Each nested shelf has a top wall and side walls. The top walls of the nested shelves and of the frame serve to support products for sale. The nested shelves are slidingly coupled together with drawer guides connected to the side walls. There is also provided a secondary or rear shelf that slides inside and out of the frame. There is also provided a top shelf on top of the frame. Wheeled legs support the rack off of the floor.

12 Claims, 7 Drawing Sheets

DISPLAY RACK

FIELD OF THE INVENTION

The present invention relates to apparatuses used to display goods, such as food items.

BACKGROUNG OF THE INVENTION

Merchandising is the promotion of the sale of an item or product by displaying or advertising the item. For example, grocery stores practice merchandising extensively. This is especially true with baked goods, produce, and meats. The items are displayed for sale on racks or stands or in bins. The objective of merchandising is to attractively display the product to a purchasing customer.

The size of the display is important. Ideally, the display should be large enough to display the desired quantity of products. Empty shelves are not attractive and are avoided by many stores.

As an example of merchandising, many grocery stores have an in store bakery. The baked goods are typically displayed for sale on a rack.

A problem arises with the volume of baked goods that are displayed. Certain days of the week may be slower, from a sales point of view, than are other days of the week. For example, in some stores, customers buy fewer baked goods on Mondays and Tuesdays than on other days of the week.

A conventional rack is undesirable to display such baked goods because of the change in volume of the goods that are to be displayed. A conventional rack may have plural shelves that are stair stepped. If a large rack is used, the rack is satisfactory for Wednesdays through Sundays, when large volumes of baked goods are displayed for sale. However, on Mondays and Tuesdays, such a rack is too large, and presents empty shelves to customers. If a smaller rack is used, the rack is satisfactory for days with low sales volume, but is too small for heavy volume sales days. Such racks on busy days must be frequently restocked, adding to labor costs.

SUMMARY OF THE INVENTION

It is an object of the present invention to provide a rack that can be adjusted to display various amounts of merchandise.

It is an object of the present invention to provide a rack that can be adjusted to display various amounts of merchandise in an easy and aesthetic manner.

The present invention provides a rack for displaying products. The rack comprises a frame, first and second nested shelves, and first and second legs. The frame comprises a top wall and side walls coupled thereto. The first and second side walls are spaced apart from each other so as to form a frame cavity therebetween. The first and second nested shelves each have a top wall and side walls coupled thereto. The side walls of each nested shelf are spaced apart from each other so as to form a shelf cavity. The first nested shelf is slidingly coupled to the frame such that the first nested shelf can move between a first stowed position inside of the cavity and a first extended position where a portion of the first nested shelf extends out from the frame cavity. The second nested shelf is slidingly coupled the first nested shelf such that the second nested shelf can move between a second stowed position inside of the shelf cavity of the first nested shelf and a second extended position where a portion of the second nested shelf extends out of the shelf cavity of the first nested shelf. The first legs are coupled to the frame. The second legs are coupled to the one of the first or second nested shelves.

In accordance with one aspect of the present invention, the nested shelves are slidingly coupled together and to the frame with drawer guides.

In accordance with another aspect of the present invention, the side walls of the first nested shelf are slidingly coupled to the side walls of the second nested shelf and also to the side walls of the frame.

In accordance with another aspect of the present invention, the side walls of the frame and the side walls of the first and second nested shelves have bottom edges, the bottom edges are planar with respect to each other.

In accordance with another aspect of the present invention, the legs comprise wheels.

In accordance with still another aspect of the present invention, the rack further comprises wagon type wheels that are mounted to the side walls of the frame.

In accordance with another aspect of the present invention, the rack further comprises a secondary shelf coupled to the frame. The secondary shelf is slidable in the frame so as to either extend from the frame or stow inside of the frame.

In accordance with another aspect of the present invention, the rack further comprises a top shelf located above the frame top wall.

In accordance with another aspect of the present invention, the top wall of the frame serves as a shelf.

In accordance with another aspect of the present invention, the top wall of the frame and the top walls of the shelves are formed of slats, separated by gaps.

The rack of the present invention provides plural nested shelves which are slidingly coupled to each other and to the frame. With the rack of the present invention, the amount of shelf space that is available for displaying products or items can be adjusted according to the volume that is desired. The nested shelves can be extended out from the frame in order to provide additional shelf space. The nested shelves can be selectively nested so as to provide less available shelf space.

BRIEF DESCRIPTION OF THE DRAWING

FIG. 6 shows the rack fully extended. FIG. 11 shows the rack fully collapsed. FIGS. 7–10 show the rack in intermediate stages of extension.

DESCRIPTION OF THE PREFERRED EMBODIMENT

Figure 1:
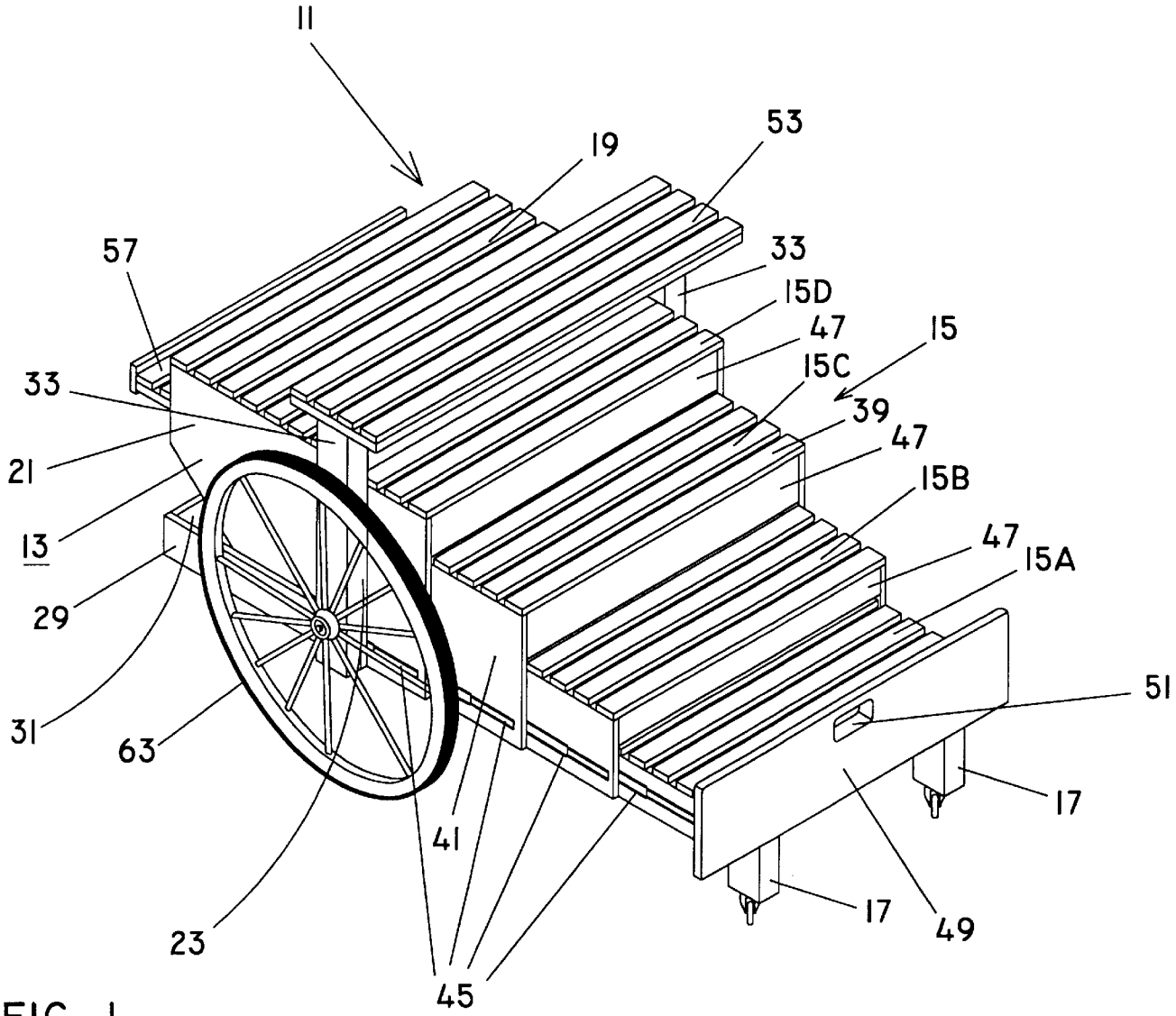
FIG. 1 is an isometric view of the rack of the present invention, in accordance with a preferred embodiment.

Referring to FIG. 1, the rack 11 of the present invention can be used to display products for sale. For example, produce or baked goods can be displayed on one of the several shelves on the rack. The size of the rack can be adjusted so as to expose for display a large amount of shelf space. Conversely, the size of the rack can be adjusted so as to expose a small amount of shelf space.

The rack of the present invention allows small quantities of products to be displayed, without showing a lot of empty shelf space. If more shelf space is needed, then the rack can be expanded so as to expose more shelf space for displaying goods.

The rack 11 will now be described in more detail. The rack has a frame 13, plural nested shelves 15, and legs 17. In the description that follows, terms such as "top", "bottom", "front", and "rear", refer to the orientation of the rack as shown in FIG. 1.

Figure 4:
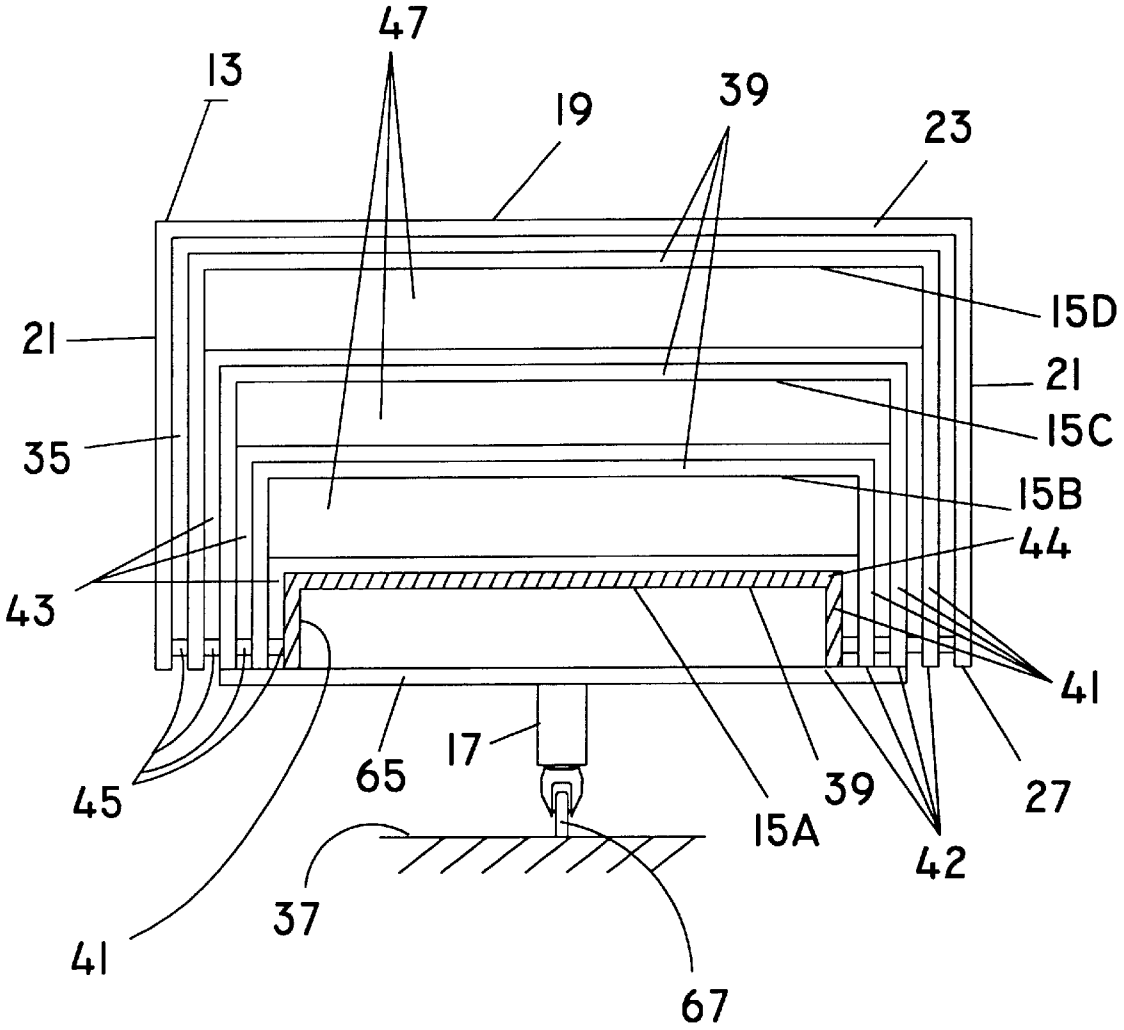
FIG. 4 is a cross-sectional view of the rack, taken through lines IV—IV of FIG. 2, showing the nested shelf arrangement.
Figure 5:
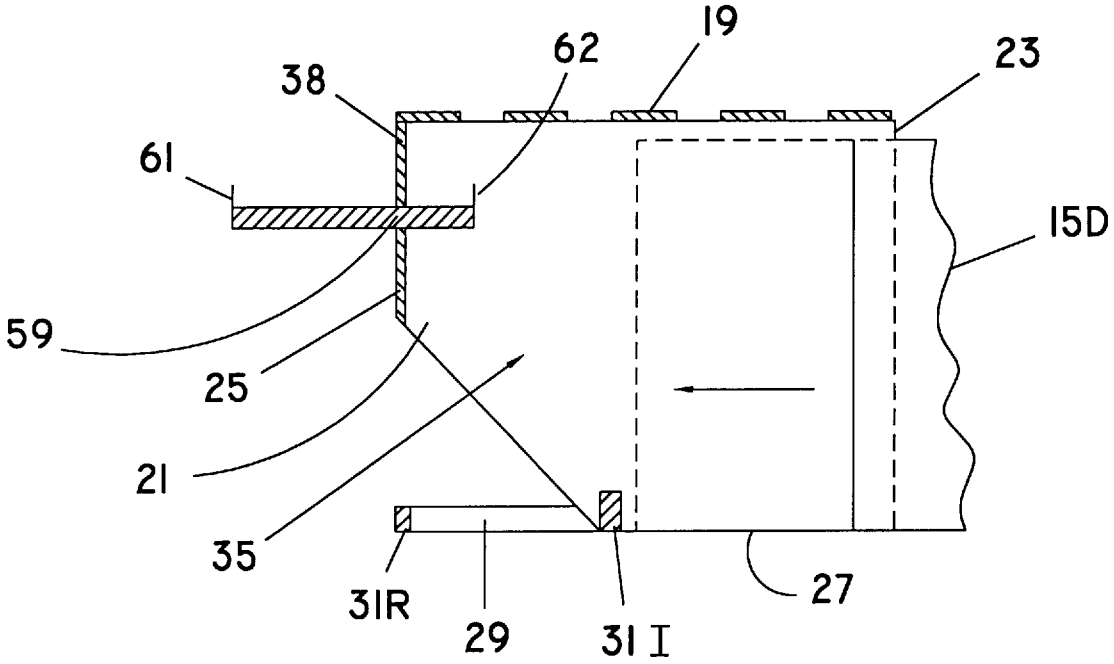
FIG. 5 is a cross-sectional view of the rear end portion of the rack, taken through lines V—V of FIG. 3.

The frame 13 forms a box-like structure. Referring to FIGS. 1, 4, and 5, the frame has a top wall 19 and two side walls 21 coupled to the top wall. The side walls 21 each have a front edge 23, a rear edge 25, and a bottom edge 27. In order to make the frame sturdy and strong, several support elements are provided. Each side wall 21 has a horizontal lateral beam 29 along its bottom edge 27. The two lateral beams 29 are joined together by transverse beams 31. There is a rear transverse beam 31R located at the rear ends of the lateral beams 29. There is also an intermediate transverse beam 31I located between the rear transverse beam 31R and the front edge 23 of the side walls. (In FIG. 5, part of the front edge 23 is shown in dashed lines.) The front edge 23 of each side wall is strengthened with a vertical post 33 that is coupled to a respective lateral beam 29.

The frame 13 has a cavity 35 therein for receiving the nested shelves 15. The cavity 35 is formed by the top and side walls 19, 21. The bottom of the cavity 35 is open to the floor 37 that supports the rack. The front of the cavity 35 is also open to receive the nested shelves 15. The rear of the cavity is partially closed with a rear wall 38 that extends down from the top wall 19.

Each nested shelf 15 has a top wall 39 and two side walls 41 coupled to the respective top wall. A cavity 43 is formed by the walls 39, 41 of each nested shelf. In transverse cross-section (see FIG. 4), each shelf 15 looks like an upside down "U". The bottom of each shelf 15 is open.

In the preferred embodiment, there are provided four nested shelves. The invention can be made with fewer or more shelves. Thus, there is a first nested shelf 15A, a second nested shelf 15B, a third nested shelf 15C, and a fourth nested shelf 15D. The height (the distance from the bottom edge 42 to the top edge 44) of the side walls 41 of the respective nested shelves vary. The height of the first nested shelf 15A is relatively short, compared to the other nested shelves. The height of the second nested shelf 15B is greater than that of the first nested shelf 15A, but less than that of the third nested shelf 15C. The height of the third nested shelf 15C is less than the height of the fourth nested shelf 15D. The height of the fourth nested shelf 15D is less than the height of the frame 13. Likewise, the width (the distance between the side walls 41) of the respective nested shelves vary. The first nested shelf 15A is of the narrowest width. The width of the second nested shelf 15B is greater than that of the first nested shelf 15A, but less than that of the third nested shelf 15C. The width of the third nested shelf 15C is less than the fourth nested shelf 15D. The width of the fourth nested shelf 15D is less than the width of the frame 13.

Figure 2:
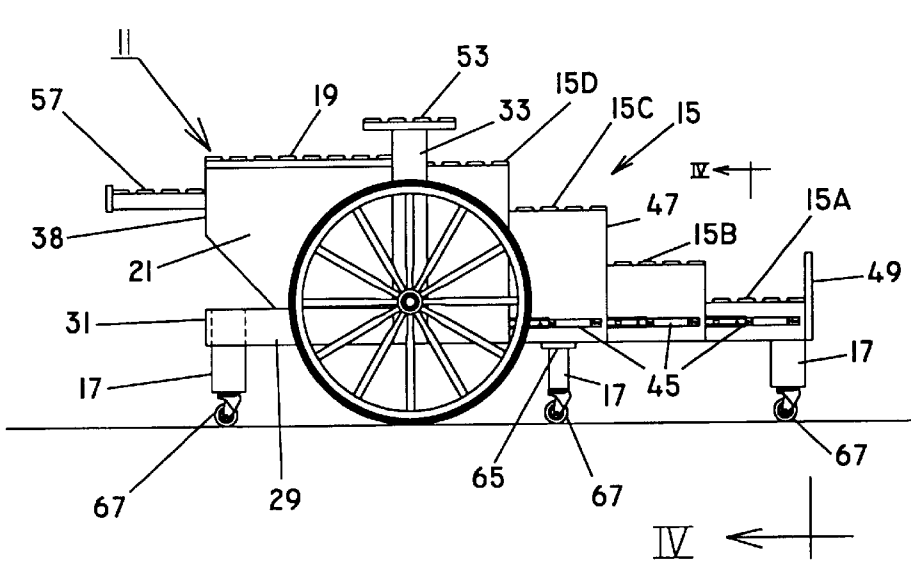
FIG. 2 is a side elevational view of the rack, with the rack being shown as fully extended.

The nested shelves are connected to each other and to the frame such that their bottom edges 42 are planar and equidistant from the floor 17 (see FIGS. 1, 2, and 4). The walls 41 are interconnected to each other by way of conventional drawer guides 45. The outside of the side walls 41 of the first nested shelf 15A are connected to the inside of the side walls 41 of the second nested shelf 15B by drawer guides 45. The outside of the side walls 41 of the second nested shelf 15B are connected to the inside of the side walls 41 of the third nested shelf 15C by drawer guides. The outside of the side walls 41 of the third nested shelf 15C are connected to the inside of the side walls 41 of the fourth nested shelf 1SD by drawer guides. The outside of the side walls 41 of the fourth nested shelf 15D are connected to the inside of the side walls 21 of the frame 13 by drawer guides. The use of drawer guides enables the nested shelves to be slid relative to each other. For example, the second nested shelf can be slid relative to the first and third nested shelves.

Figure 3:
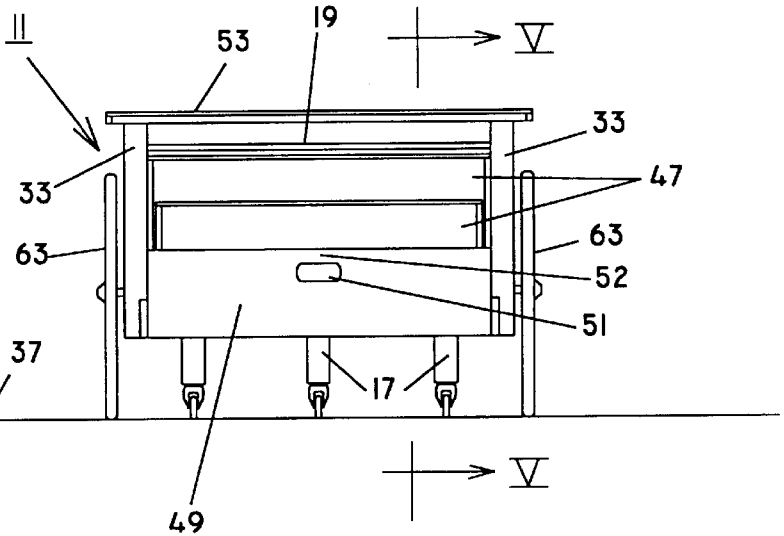
FIG. 3 is a front end elevational view of the rack.

The top wall 39 of the fourth nested shelf 15D is located just under the top wall 19 of the frame 13. A small clearance gap separates the two. Larger gaps separate the top walls 39 of the first and second nested shelves 15A, 15B, the top walls 39 of the second and third nested shelves 15B, 15C, and the top walls 39 of the third and fourth nested shelves 15C, 15D. To fill these larger gaps, the nested shelves are provided with front walls 47. Thus, the second nested shelf 15B has a front wall 47 that extends down to the top wall 39 of the first nested shelf 15A (leaving a clearance gap between the bottom edge of the front wall and the first nested shelf top wall). Likewise, the third and fourth nested shelves 15C, 15D have similar front walls 47. The first nested shelf 15A has a front wall 49 that extends up beyond the top wall and out beyond the side walls of the first nested shelf. The front wall 49 serves as a stop for retaining products on the first nested shelf 15A. The width of the front wall 49 is about the same as the distance between the frame side walls 21. The front wall 49 serves to hide the drawer guides 45 when the rack is collapsed, as shown in FIG. 3. A central opening 51 is provided in the front wall to form a handle 52. The handle is useful when extending or collapsing the nested shelves 15.

There is provided a top shelf 53 (see FIGS. 1–3). The vertical posts 33 extend up past the frame top wall 19 for some distance. The top shelf 53 extends between the two posts. The front and rear edges of the top shelf can be equipped with an upstanding lip (not shown) to retain the goods on the shelf.

There is also provided a rear shelf 57. The rear wall 38 of the frame 13 has a horizontal slot 59 therein (see FIG. 5). The rear shelf 57 is located in this slot 59. The rear shelf has an outer upstanding edge 61 and an inner upstanding edge 62. The two upstanding edges act as stops against the rear wall 38. The inner upstanding edge 62 is located inside of the frame, while the outer upstanding edge 61 is located outside of the frame. The rear shelf 57 can be moved between a stowed position and an extended position. In the stowed position, the shelf is located inside of the frame. In the extended position, the shelf extends from the rear of the frame as shown in FIG. 2. Guides can be attached to the inside of the frame side walls 21 in order to guide the rear shelf 57.

In the preferred embodiment, the top walls 39, 19 of the nested shelves 15 and the frame 13, and the rear shelf 57 are made of slats that are interleagued with narrow gaps. This adds to the overall aesthetic look of the rack. The top walls of the nested shelves 15 have a cross-piece underneath for support. The top walls could be made of solid pieces instead of strips of material.

The rack is supported up off of the floor 37 by legs 17 and wheels 63 (see FIGS. 2, 3, and 4). The rear end of the frame 13 is supported by a leg 17 that is connected to the rear transverse beam 31R. The first nested shelf 1SA has two laterally spaced apart legs 17 that depend down from the side walls 41. The legs are mounted to the inside of the side walls. The third nested shelf 15C also has a leg 17. A beam 65 extends between the side walls of the third nested shelf 15C. The beam abuts the bottom edge of the side walls 41 so as not to interfere with the nesting of the first and second nested shelves 15A, 15B inside of the third nested shelf 15C. The leg 13 depends from this beam 65. Each leg 17 has a caster wheel 67 thereon so as to allow the rack to be easily positioned and also allow easy deployment and storage of the nested shelves. The caster wheels are conventional and commercially available and are equipped with releasable locks or brakes to selectively prevent rotation thereof. A wagon wheel 63 is rotatably connected to each vertical posts 33. Thus, there is a wheel 63 on each side of the rack 11.

The rack 11 need not be provided with wagon wheels 63 and could have legs in place of these wheels. Also, the legs can be wheelless.

Figure 6:
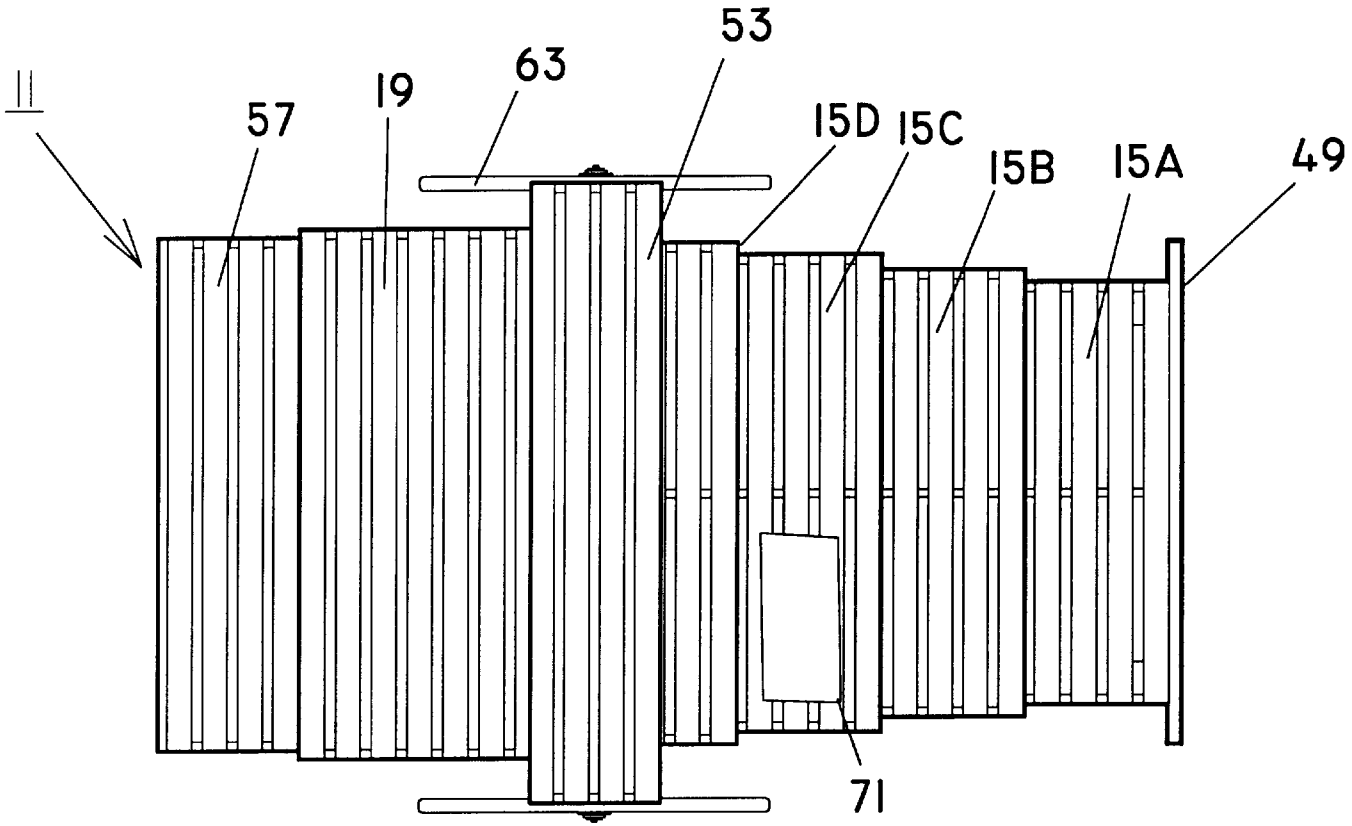
FIGS. 6–11 are top plan views of the rack in its various stages of extension.

The operation of the rack 13 will now be described. In FIGS. 1 and 6 the rack is shown in its fully extended position. The nested shelves 15A, 15B, 15C, 15D are all exposed, as is the rear shelf 57. Products 71 such as baked goods, produce, floral items, etc. are placed on the top wall 39 of each of the shelves 15, as well as the top wall 19 of the frame, and the rear shelf 57. Also, the top shelf 53 can be used to display products or items for sale.

Figure 7:
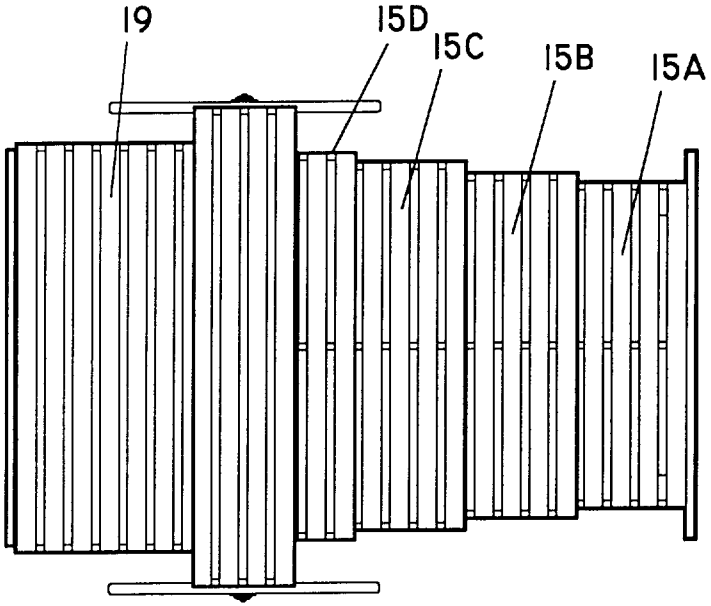

To reduce the amount of shelf space that is exposed to view and for holding products or goods, the rear shelf 57 can be pushed into the frame as shown in FIG. 7. Alternatively, the rear shelf can be left out, and one or more of the nested shelves can be pushed in to the frame. In addition, both the rear shelf and one or more of the nested shelves can be pushed into the frame to reduce the amount of the shelf space that is exposed.

Figure 8:
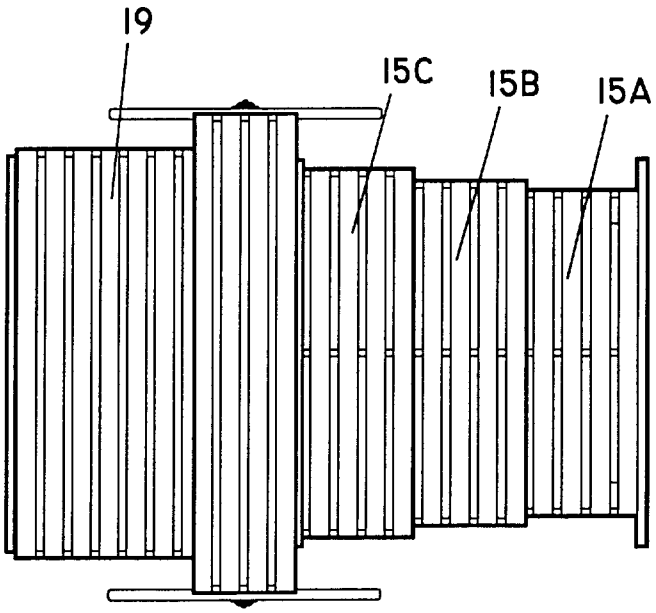

The nesting of the nested shelves 15 will now be described. To nest a shelf, force is applied to the specific shelf that is to be nested. For example, to nest the fourth nested shelf 15D into the frame 13, the fourth nested shelf 15D is pushed into the frame 13 along its front edges or front wall. The rack now appears as shown in FIG. 8. Only three nested shelves 15A, 15B, 15C are exposed.

Figure 9:
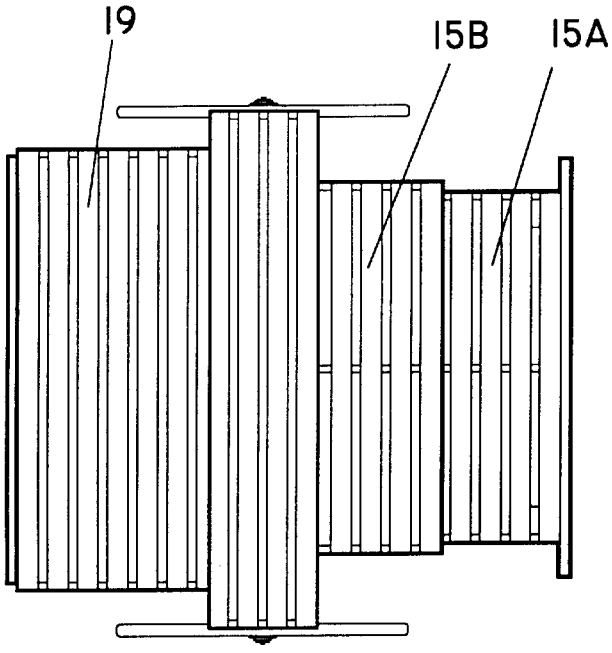

To further reduce shelf space, the third nested shelf 15C can be pushed in or nested into the frame, as shown in FIG. 9. Once pushed in, the third nested shelf nests inside of the fourth nested shelf. Only two nested shelves 15A, 1 5B are now exposed.

Figure 10:
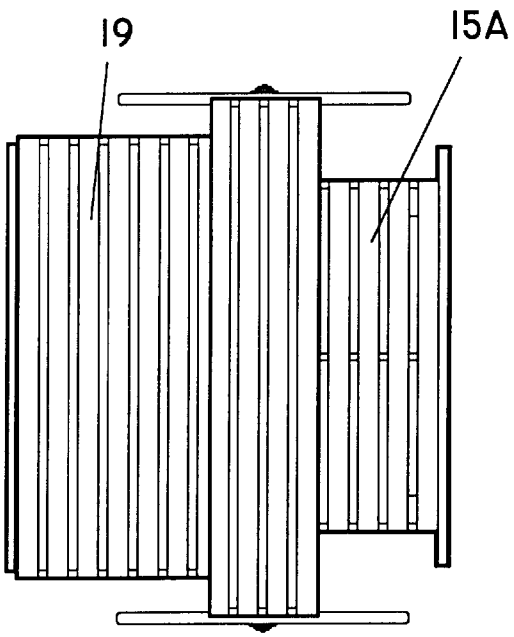

To further reduce shelf space, the second nested shelf 15B can be pushed into or nested into the third nested shelf 15C. As shown in FIG. 10, only one nested shelf 15A is now exposed.

Figure 11:
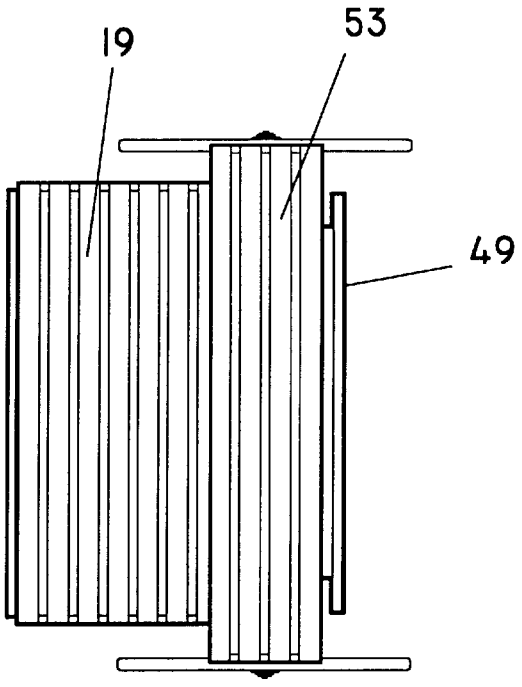

To further reduce shelf space, the first nested shelf 15A can be pushed in or nested into the second nested shelf. As shown in FIG. 11, no nested shelves are exposed.

FIGS. 7–11 show one particular sequence of nesting the shelves. The nested shelves can be nested in any particular order. For example, the first and third nested shelves can be exposed, while the second or fourth nested shelves are nested.

To add more shelf space, either the rear shelf 57 and/or one or more of the nested shelves 15 are pulled out from the frame or from the other nested shelves.

The drawer guides 45 can act as stops to prevent over extension of the nested shelves when being pulled out. Likewise, the drawer guides can act as stops to prevent pushing in the nested shelves too far into the frame. The transverse beam 31I (see FIG. 5) can also act as a stop to prevent the nested shelf from being pushed into the frame too far. (In FIG. 5, the fourth nested shelf 15D is shown in dashed lines as being nested inside of the frame.)

The drawer guides 45 and wheeled legs 17 allow the nested shelves to be pushed in or pulled out of the frame with ease.

The use of the rack 11 allows the amount of shelf space to be adjusted. The stair stepped arrangement of the nested shelf provides an aesthetic arrangement.

The rack can be made of wood or metal. The drawer guides are preferably made of metal.

The foregoing disclosure and the showings made in the drawings are merely illustrative of the principles of this invention and are not to be interpreted in a limiting sense.

We claim:

1. A rack for displaying products, comprising:

a) a frame comprising a top wall and side walls coupled thereto, the side walls being spaced apart from each other so as to form a frame cavity therebetween;

b) first and second nested shelves, each of which has a top wall and side walls coupled thereto, the side walls of each nested shelf being spaced apart from each other so as to form a shelf cavity, the first nested shelf being slidingly coupled to the frame such that the first nested shelf can move between a first stowed position inside of the frame cavity and a first extended position where a portion of the first nested shelf extends out from the frame cavity, the second nested shelf being slidingly coupled to the first nested shelf such that the second nested shelf moves between a second stowed position inside of the shelf cavity of the first nested shelf and a second extended position where a portion of the second nested shelf extends out of the shelf cavity of the first nested shelf;

c) first legs coupled to the frame;

d) second legs coupled to one of the first or second nested shelves.

2. The rack of claim 1 wherein the nested shelves are slidingly coupled together and to the frame with drawer guides.

3. The rack of claim 2 wherein the side walls of the first nested shelf are slidingly coupled to the side walls of the second nested shelf and to the side walls of the frame.

4. The rack of claim 2 wherein the side walls of the frame and the side walls of the first and second nested shelves have bottom edges, the bottom edges being planar with respect to each other.

5. The rack of claim 1 wherein the nested shelves are of varying height so as form a stair-stepped structure when the nested shelves are in their respective first and second extended positions.

6. The rack of claim 1 wherein the legs comprise wheels.

7. The rack of claim 1 further comprising wagon type wheels mounted to the frame side walls.

8. The rack of claim 1 further comprising a secondary shelf coupled to the frame, the secondary shelf being slidable in the frame so as to either extend from the frame or stow inside of the frame.

9. The rack of claim 1 further comprising a top shelf located above the frame top wall.

10. The rack of claim 1 wherein the top wall of the frame is a shelf.

11. The rack of claim 1 wherein the top wall of the frame and the top walls of the shelves are formed of slats, separated by gaps.

12. The rack of claim 1 wherein:

a) the nested shelves are slidingly coupled together and to the frame with drawer guides;

b) the side walls of the first nested shelf are slidingly coupled to the side walls of the second nested shelf and to the side walls of the frame;

c) the side walls of the frame and the side walls of the first and second nested shelves have bottom edges, the bottom edges being planar with respect to each other;

d) the nested shelves are of varying height so as to form a stair-stepped structure when the nested shelves are in their respective first and second extended positions;

e) the legs comprise wheels;

f) a secondary shelf is coupled to the frame, the secondary shelf being slideable in the frame so as to either extend from the frame or stow inside of the frame.

* * * * *